US007229128B2

(12) United States Patent
Lee

(10) Patent No.: US 7,229,128 B2
(45) Date of Patent: Jun. 12, 2007

(54) COLLAPSIBLE CHAIR WITH SAFETY LOCK

(75) Inventor: Yangsun Lee, Fujian (CN)

(73) Assignee: North Pole Limited, Kowloon (HK)

( * ) Notice: Subject to any disclaimer, the term of this patent is extended or adjusted under 35 U.S.C. 154(b) by 240 days.

(21) Appl. No.: 10/941,122

(22) Filed: Sep. 15, 2004

(65) Prior Publication Data

US 2006/0054753 A1 Mar. 16, 2006

(51) Int. Cl.
*A47C 4/00* (2006.01)
*A47D 1/02* (2006.01)

(52) U.S. Cl. ..... 297/16.2; 297/45; 248/188.6

(58) Field of Classification Search ..... 248/166, 248/164, 188, 188.1; 297/16.2, 45, 42
See application file for complete search history.

(56) References Cited

U.S. PATENT DOCUMENTS 3,498,412 A * 3/1970 Best ..... 182/152
5,400,870 A * 3/1995 Inoue ..... 182/178.6
5,437,425 A * 8/1995 Hou ..... 248/188.6
5,645,259 A * 7/1997 Chen ..... 248/436
5,984,406 A * 11/1999 Lee ..... 297/16.2
6,082,813 A * 7/2000 Chen ..... 297/16.2
6,231,119 B1 * 5/2001 Zheng ..... 297/16.2
6,264,271 B1 * 7/2001 Munn et al. ..... 297/45
6,296,304 B1 * 10/2001 Zheng ..... 297/45
6,302,479 B1 * 10/2001 Zheng ..... 297/16.2
6,322,138 B1 * 11/2001 Tang ..... 297/45
6,398,297 B1 * 6/2002 Cantwell ..... 297/33
6,505,885 B1 * 1/2003 Tang ..... 297/16.2
6,575,534 B2 * 6/2003 Chen ..... 297/411.43
6,634,609 B2 * 10/2003 Zheng ..... 248/277.1
6,736,450 B2 * 5/2004 Miyagi ..... 297/16.2
6,776,433 B2 * 8/2004 Harrison et al. ..... 280/647
7,066,534 B2 * 6/2006 Choi ..... 297/16.2

* cited by examiner

*Primary Examiner*—Anita M. King
(74) *Attorney, Agent, or Firm*—Armstrong Teasdale LLP

(57) ABSTRACT

Collapsible furniture includes a frame structure configured to support weight, including a plurality of scissor members configured to fold and a plurality of upright members, each coupled to at least two of the scissor members. The collapsible furniture also includes a lock mechanism coupled to at least two of the scissor members and at least one of the upright members, configured to secure the collapsible furniture in a deployed position. In one aspect, the lock mechanism includes a housing, slidingly coupled to an upright member, configured to couple at least two of the scissor members to the upright member, a button member slidingly coupled to the housing, configured to extend through an opening on inner surface of the housing into the upright member when in a depressed position, and to extend outside outer surface of the housing when in an extended position, a spring plate, and a spring. Advantages of the invention include providing a safety feature in use of the collapsible furniture.

20 Claims, 2 Drawing Sheets

COLLAPSIBLE CHAIR WITH SAFETY LOCK

FIELD

The present invention relates generally to furniture, and more particularly to collapsible furniture.

BACKGROUND

Collapsible furniture is known to provide relaxation as well as convenience and portability to furniture users, because the furniture can be easily transported and deployed. However, conventional collapsible furniture may pose safety hazards, especially to child furniture users, in that the furniture user's fingers or other body parts may be pinched in the furniture when it is deployed or collapsed.

Accordingly, what is needed is collapsible furniture that provides a safety feature to prevent injury during deployment and collapsing.

SUMMARY

The invention overcomes the identified limitations and provides a safety lock for collapsible furniture.

An exemplary embodiment of collapsible furniture includes a frame structure configured to support weight. The frame structure includes a plurality of scissor members configured to fold and a plurality of upright members, each coupled to at least two of the scissor members and configured to support a corner of the frame structure. The collapsible furniture also includes a lock mechanism coupled to at least two of the scissor members and at least one of the upright members, configured to secure the collapsible furniture in a deployed position.

In one aspect, the lock mechanism includes a housing, slidingly coupled to an upright member, configured to couple at least two of the scissor members to the upright member and to house at least one other lock mechanism component. A button member is slidingly coupled to the housing and is configured to slide within the housing and to extend through an opening on inner surface of the housing into the upright member when in a depressed position, and to extend outside outer surface of the housing when in an extended position. The lock mechanism also includes a spring plate, coupled to the inside of the upright member and configured to extend through the opening of the inner surface of the housing and the upright member to prevent the lock mechanism from sliding along the upright member, and to allow the lock mechanism to slide along the upright member when depressed by the button member. The spring is coupled to inside of the housing and to the button member, and is configured to return the button member to the extended position after depression.

In another aspect, the collapsible furniture also includes a support member coupled to the upright member below the lock mechanism, configured to provide vertical support to the lock mechanism.

In another aspect, the button member includes an inner part slidingly coupled to the housing, configured to slide within the housing and to extend through the opening on the inner surface of the housing into the upright member when in the depressed position, and, an outer part, coupled to the inner part, configured to extend outside the outer surface of the housing when in the extended position to provide a contact point for the furniture user to depress the button member.

In another aspect, the lock mechanism is also configured to secure the collapsible furniture in a collapsed position. In another aspect, the number of the upright members is two.

Another embodiment of collapsible furniture includes a frame structure configured to support weight, which includes a plurality of scissor members configured to fold and a pair of upright members, each coupled to at least two of the scissor members and configured to support a corner of the frame structure. The collapsible furniture also includes the lock mechanism, coupled to at least two of the scissor members and an upright member, configured to secure the collapsible furniture in a deployed position.

Advantages of the invention include providing a safety feature in use of the collapsible furniture.

DRAWINGS

The invention will be described with reference to the drawings, in which.

DETAILED DESCRIPTION

Exemplary embodiments are described herein to provide a detailed description of the invention. Variations of these embodiments will be apparent to those of skill in the art. For example, the invention is described with reference to a lock mechanism for collapsible chairs, but the invention may also apply to lock mechanisms for other types of collapsible furniture, such as cots or lounge chairs. The lock mechanism may be used in conjunction with child or adult furniture.

Figure 1:
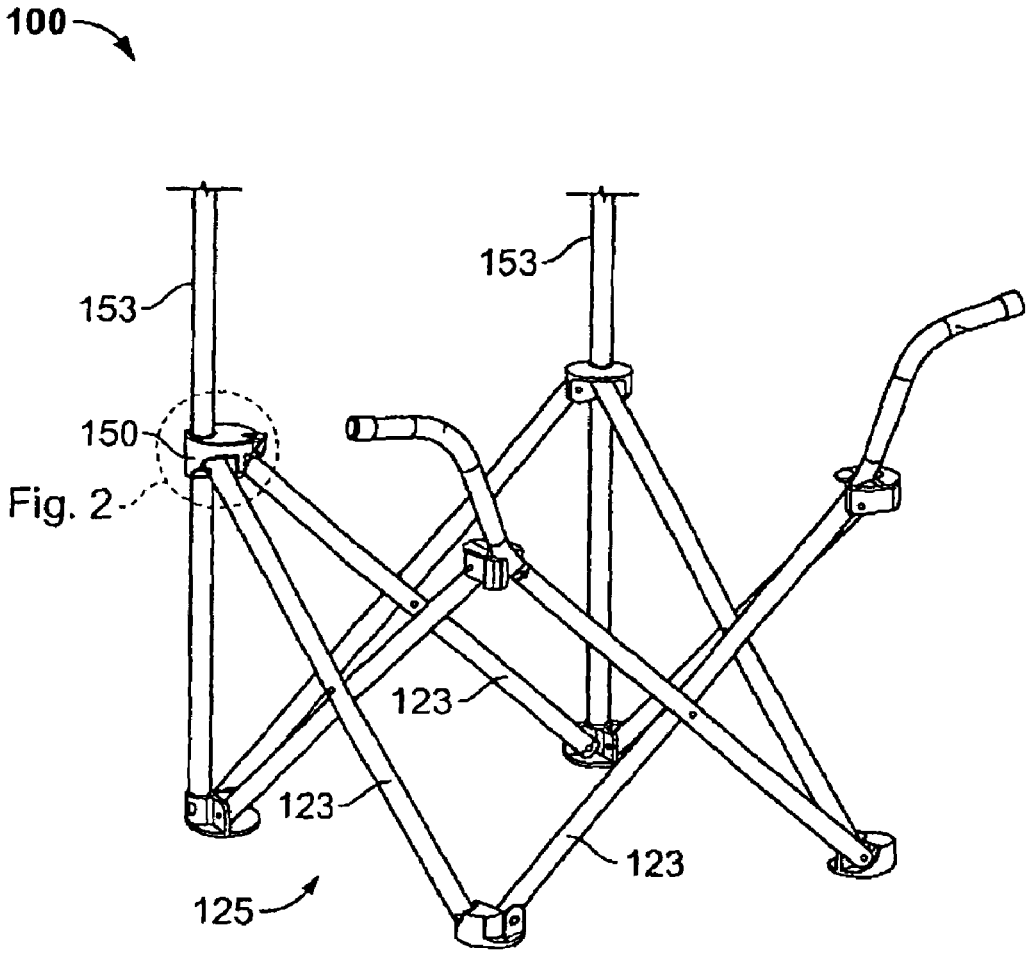
FIG. 1 is a perspective view showing collapsible furniture with a lock mechanism, according to one embodiment of the invention.

FIG. 1 is a perspective view showing collapsible furniture 100 with a lock mechanism 150, according to one embodiment of the invention. In the embodiment, the collapsible furniture 100 includes a frame structure 125 configured to support weight. The frame structure 125 includes a plurality of scissor members 123 configured to fold and a plurality of upright members 153, each coupled to at least two of the scissor members 123 and configured to support a corner of the frame structure 125. The collapsible furniture 100 also includes a lock mechanism 150 coupled to at least two of the scissor members 123 and at least one of the upright members 153, configured to secure the collapsible furniture 100 in a deployed position. In one aspect, the lock mechanism 150 is also configured to secure the collapsible furniture 100 in a collapsed position.

In the embodiment depicted in FIG. 1, the number of the upright members is two. Thus, in the embodiment, the collapsible furniture 100 includes a frame structure 125 configured to support weight, which includes a plurality of scissor members 123 configured to fold and a pair of upright members 153, each coupled to at least two of the scissor members 123 and configured to support a corner of the frame structure 125. The collapsible furniture 100 also includes the lock mechanism 150, coupled to at least two of the scissor members 123 and an upright member 153, configured to secure the collapsible furniture 153 in a deployed position. Although the collapsible furniture 100 has two upright members 153, other embodiments of collapsible furniture may have fewer or more upright members. For example, the collapsible furniture may have 0, 1, 2, 3, 4, 5, or 6 upright members.

Figure 2:
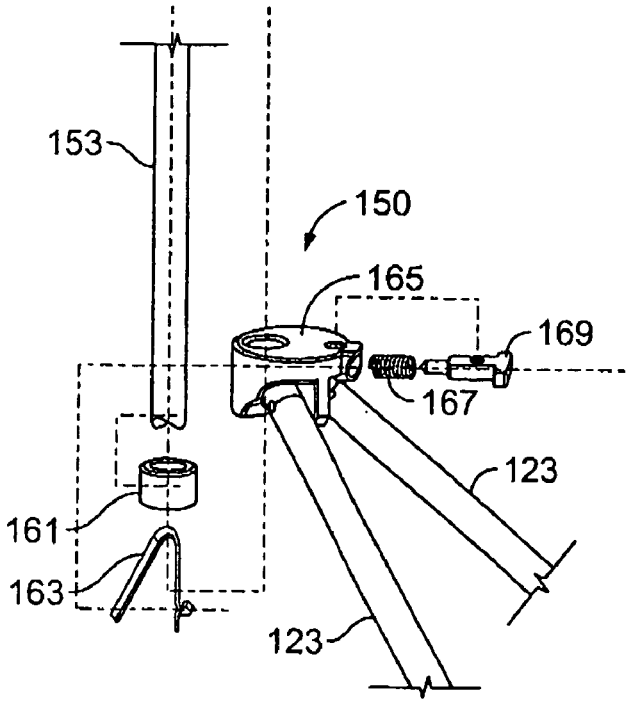
FIG. 2 is an exploded view showing the lock mechanism, according to one embodiment of the invention.

FIG. 2 is an exploded view showing the lock mechanism 150, according to one embodiment of the invention. In the embodiment, the lock mechanism 150 includes a housing 165, slidingly coupled to an upright member 153, configured to couple at least two of the scissor members 123 to the upright member 153 and to house at least one other lock mechanism component, such as a button member 169 or a spring 167, described below. The button member 169 is slidingly coupled to the housing 165 and is configured to slide within the housing 165 and to extend through an opening 177 on inner surface of the housing 165 into the upright member 153 when in a depressed position, and to extend outside outer surface of the housing 165 when in an extended position. When the button member 169 extends through the opening 177 on the inner surface of the housing 165 into the upright member 153, it may just penetrate outer wall of the upright member 153, or it may penetrate more deeply into the upright member 153. The lock mechanism also includes a spring plate 163, coupled to the inside of the upright member 153 and configured to extend through the opening 177 of the inner surface of the housing 165 and the upright member 153 to prevent the lock mechanism 150 from sliding along the upright member 153, and to allow the lock mechanism 150 to slide along the upright member 153 when depressed by the button member 169. The spring 167 is coupled to inside of the housing 165 and to the button member 169, and is configured to return the button member 169 to the extended position after depression.

In operation of the lock mechanism 150, the button member 169 is pushed into a depressed position by a furniture user to allow the lock mechanism 150 to slide along the upright member 153. When the lock mechanism 150 is free to slide along the upright member 153, the collapsible furniture 100 may be collapsed or deployed. However, if the lock mechanism 150 is not free to slide along the upright member 153, then the collapsible furniture 100 is locked in a deployed or collapsed position.

In one embodiment, the collapsible furniture 100 also includes a support member 161 coupled to the upright member 153 below the lock mechanism 150, configured to provide vertical support to the lock mechanism 150. In the embodiment, the lock mechanism 150 is used to secure the collapsible furniture 100 in a deployed position, and provides support to the lock mechanism 150 in resisting downward forces, such as those forces due to the weight of the furniture user sitting in the collapsible furniture 100.

Figure 3:
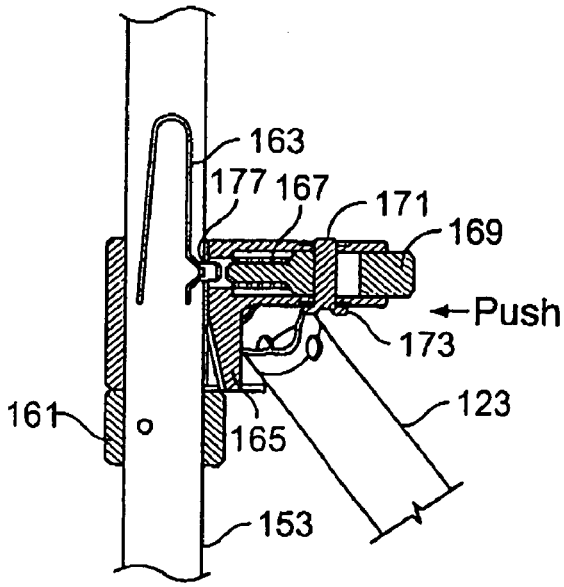
FIG. 3 is a sectional view showing the lock mechanism, according to one embodiment of the invention.

FIG. 3 is a sectional view showing the lock mechanism 150, according to one embodiment of the invention. As shown in the embodiment depicted in FIG. 3, the lock mechanism may also include a fastener 171 and a washer 173 to secure lock mechanism components.

In one aspect, the button member 169 is of one-piece construction. In another aspect, the button member 169 includes an inner part slidingly coupled to the housing 165, configured to slide within the housing 165 and to extend through the opening on the inner surface of the housing into the upright member when in the depressed position, and, an outer part, coupled to the inner part, configured to extend outside the outer surface of the housing 165 when in the extended position to provide a contact point for the furniture user to depress the button member 169.

Advantages of the invention include providing a safety feature in use of the collapsible furniture.

Having disclosed exemplary embodiments and the best mode, modifications and variations may be made to the disclosed embodiments while remaining within the subject and spirit of the invention as defined by the following claims.

The invention claimed is:

1. A collapsible furniture piece comprising:

a frame structure configured to support weight, the frame structure comprising:

a plurality of scissor members configured to fold; and a plurality of upright members, a first upright member of the plurality of upright members coupled to at least two scissor members of the plurality of scissor members and configured to support at least a portion of the frame structure; and a lock mechanism coupled to the at least two scissor members and the first upright member, the lock mechanism configured to secure the collapsible furniture piece in a deployed position, the lock mechanism comprising:

a housing defining a first opening; and a button member slidably positioned within the first opening, the button member movable between a depressed position and an extended position, in the depressed position a portion of the button member positioned within a second opening defined within a wall of the first upright member.

2. A collapsible furniture piece in accordance with claim 1 wherein the lock mechanism is configured to secure the collapsible furniture in a collapsed position.

3. A collapsible furniture piece in accordance with claim 1 wherein the lock mechanism further comprises a spring plate coupled to an inside surface of the wall, the spring plate configured to extend through the second opening and interfere with the lock mechanism to facilitate limiting sliding of the lock mechanism along the first upright member.

4. A collapsible furniture piece in accordance with claim 3 wherein the spring plate facilitates sliding of the lock mechanism along the first upright member when depressed by the button member.

5. A collapsible furniture piece in accordance with claim 1 further comprising a spring positioned within the first opening and configured to bias the button member toward the extended position.

6. A collapsible furniture piece in accordance with claim 1 wherein, with the button member in the depressed position, the lock mechanism is slidably movable along the first upright member.

7. A collapsible furniture piece in accordance with claim 1 further comprising a support member coupled to the first upright member below the lock mechanism, the support member configured to provide vertical support to the lock mechanism.

8. A collapsible furniture piece in accordance with claim 1 wherein the button member further comprises:

an inner part slidably positioned within the first opening, the inner part extending into the second opening with the button member in the depressed position; and an outer part coupled to the inner part, the outer part configured to extend outwardly with respect to the housing with the button member in the extended position to provide a contact point.

9. A collapsible furniture piece comprising:

a frame structure comprising:

a plurality of scissor members configured to fold; and a plurality of upright members, a first upright member of the plurality of upright members coupled to at least two scissor members of the plurality of scissor members and configured to support at least a portion of the frame structure; and a lock mechanism coupled to the at least two scissor members and the first upright member, the lock mechanism configured to secure the collapsible furniture piece in a deployed position, the lock mechanism comprising:

a housing slidably coupled to the first upright member, the housing configured to couple the at least two scissor members to the first upright member, the housing defining a first opening;

a button member slidably positioned within the first opening, the button member configured to extend through a second opening defined within a wall of the first upright member when in a depressed position, and to extend outwardly with respect to the housing when in an extended position;

a spring plate coupled to an inside surface of the wall, the spring plate configured to extend through the second opening to prevent the lock mechanism from sliding along the first upright member, and to allow the lock mechanism to slide along the first upright member when depressed by the button member; and a spring positioned within the first opening, the spring configured to return the button member to the extended position after depression.

10. A collapsible furniture piece in accordance with claim 9 further comprising a support member coupled to the first upright member below the lock mechanism, the support member configured to provide vertical support to the lock mechanism.

11. A collapsible furniture piece in accordance with claim 9 wherein the button member comprises:

an inner part configured to slide within the housing, and extend through the first opening and into the second opening when in the depressed position; and an outer part coupled to the inner part, the outer part configured to extend outwardly with respect to the housing when in the extended position to provide a contact point for a user to depress the button member.

12. A collapsible furniture piece comprising:

a frame structure configured to support weight, the frame structure comprising:

a plurality of scissor members configured to fold; and a pair of upright members, each upright member of the pair of upright members coupled to at least two scissor members of the plurality of scissor members and configured to support a corner of the frame structure; and a lock mechanism coupled to the at least two scissor members and a first upright member, the lock mechanism comprising:

a housing defining a first opening; and a button member slidably positioned within the first opening, the button member movable between a depressed position and an extended position, in the depressed position a portion of the button member positioned within a second opening defined within a wall of the first upright member.

13. A collapsible furniture piece in accordance with claim 12 wherein the lock mechanism is configured to secure the collapsible furniture piece in at least one of a deployed position and a collapsed position.

14. A collapsible furniture piece in accordance with claim 12 wherein the lock mechanism further comprises a spring plate coupled to an inside surface of the wall, the spring plate configured to extend through the second opening and interfere with the lock mechanism to facilitate limiting sliding of the lock mechanism along the first upright member.

15. A collapsible furniture piece in accordance with claim 14 wherein, with the button member in the depressed position, the button member is configured to remove the spring plate from within the second opening to facilitate sliding of the lock mechanism along the first upright member.

16. A collapsible furniture piece in accordance with claim 12 further comprising a spring positioned within the first opening and configured to bias the button member toward the extended position.

17. A collapsible furniture piece in accordance with claim 12 wherein, with the button member in the depressed position, the lock mechanism is slidably movable along the first upright member.

18. A collapsible furniture piece comprising:

a frame structure comprising:

a plurality of scissor members configured to fold; and a pair of upright members, each upright member of the pair of upright members coupled to at least two scissor members of the plurality of scissor members and configured to support at least a portion of the frame structure; and a lock mechanism coupled to the at least two scissor members and a first upright member, the lock mechanism comprising:

a housing slidably coupled to the first upright member, the housing configured to couple the at least two scissor members to the first upright member, the housing defining a first opening;

a button member slidably positioned within the first opening, the button member configured to extend through a second opening defined within a wall of the first upright member when in a depressed position, and to extend outwardly with respect to the housing when in an extended position;

a spring plate coupled to an inside surface of the wall, the spring plate configured to extend through the second opening to prevent the lock mechanism from sliding along the first upright member, and to allow the lock mechanism to slide along the first upright member when depressed by the button member; and a spring positioned within the first opening, the spring configured to return the button member to the extended position after depression.

19. A collapsible furniture piece in accordance with claim 18 further comprising a support member coupled to the first upright member below the lock mechanism, the support member configured to provide vertical support to the lock mechanism.

20. A collapsible furniture piece in accordance with claim 18 wherein the button member comprises:

an inner part configured to slide within the housing, and extend through the first opening and into the second opening when in the depressed position; and an outer part coupled to the inner part, the outer part configured to extend outwardly with respect to the housing when in the extended position to provide a contact point for a user to depress the button member.

* * * * *